US009915150B2

(12) United States Patent
Dahlke et al.

(10) Patent No.: US 9,915,150 B2
(45) Date of Patent: Mar. 13, 2018

(54) TURBINE BLADE

(71) Applicant: Siemens Aktiengesellschaft, Munich (DE)

(72) Inventors: Stefan Dahlke, Mülheim a.d. Ruhr (DE); Tilman Auf dem Kampe, Charlotte, NC (US); Marc Fraas, Karlsruhe (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 15/505,185

(22) PCT Filed: Aug. 21, 2015

(86) PCT No.: PCT/EP2015/069232
§ 371 (c)(1),
(2) Date: Feb. 20, 2017

(87) PCT Pub. No.: WO2106/030289
PCT Pub. Date: Mar. 3, 2016

(65) Prior Publication Data

US 2017/0268347 A1 Sep. 21, 2017

(30) Foreign Application Priority Data

Aug. 26, 2014 (EP) ..... 14182277

(51) Int. Cl.
*F01D 5/18* (2006.01)

(52) U.S. Cl.
CPC ..... *F01D 5/187* (2013.01); *F05D 2230/211* (2013.01); *F05D 2250/141* (2013.01); *F05D 2260/202* (2013.01)

(58) Field of Classification Search
CPC ..... F01D 5/186; F01D 5/187; F01D 25/12; F05D 2250/311; F05D 2250/313; F05D 2250/324; F05D 2260/202
See application file for complete search history.

(56) References Cited

U.S. PATENT DOCUMENTS 3,542,486 A * 11/1970 Kercher ..... F01D 5/187 415/115
4,738,588 A * 4/1988 Field ..... F01D 5/186 415/115

(Continued)

FOREIGN PATENT DOCUMENTS

EP 1609949 A1 12/2005
EP 2492454 A2 8/2012

(Continued)

OTHER PUBLICATIONS

CN Office Action dated Jul. 31, 2017, for CN patent application No. 201580045953.2.

(Continued)

*Primary Examiner* — Ninh H Nguyen
(74) *Attorney, Agent, or Firm* — Beusse Wolter Sanks & Maire

(57) ABSTRACT

A turbine blade for a turbomachine having a turbine blade wall and a fluid channel having inlet channel section on the end region leading to the cold side, outlet channel section on the end region leading to the hot side, and central channel section therebetween having a circular cross-section constant along the length. The turbine blade forms an acute angle with the surface of the turbine blade wall over which hot gas flows, and has an intermediate channel section between the inlet and central channel sections, the intermediate channel section having a larger cross-sectional area than the central channel section. The central channel section connects to the intermediate channel section forming a (Continued)

shoulder surface formed on a wall region of the fluid channel and, on the opposing wall region, the intermediate and central channel sections merge with one another in a linear manner with a reduced shoulder height.

17 Claims, 6 Drawing Sheets

(56) References Cited

U.S. PATENT DOCUMENTS

| | | | | |
|---|---|---|---|---|
| 5,223,320 | A | 6/1993 | Richardson | |
| 6,092,982 | A * | 7/2000 | Ikeda | F01D 5/186 137/806 |
| 8,683,813 | B2 * | 4/2014 | Xu | F01D 5/186 415/115 |
| 2009/0304499 | A1 | 12/2009 | Strock | |
| 2012/0107135 | A1 | 5/2012 | Harris et al. | |
| 2014/0161625 | A1 | 6/2014 | Zhang et al. | |
| 2014/0271129 | A1 | 9/2014 | Mueller et al. | |

FOREIGN PATENT DOCUMENTS

| | | | |
|---|---|---|---|
| EP | 2584147 | A1 | 4/2013 |
| EP | 2818637 | A1 | 12/2014 |
| GB | 2244673 | A | 12/1991 |
| JP | 2006307842 | A | 11/2006 |
| JP | 2012102726 | A | 5/2012 |
| JP | 2014114816 | A | 6/2014 |
| JP | 2014208373 | A | 11/2014 |
| WO | 2013089255 | A1 | 6/2013 |

OTHER PUBLICATIONS

JP Office Action dated Aug. 21, 2017, for JP patent application No. 2017-511287.

EP Search Report dated Feb. 3, 2015, for EP patent application No. 14182277.5.

International Search Report dated Nov. 23, 2015, for PCT/EP2015/069232.

EP Office Action dated Jan. 3, 2018, for EP patent application No. 15760398.6.

* cited by examiner

TURBINE BLADE

CROSS REFERENCE TO RELATED APPLICATIONS

This application is the US National Stage of International Application No. PCT/EP2015/069232 filed Aug. 21, 2015, and claims the benefit thereof. The International Application claims the benefit of European Application No. EP14182277 filed Aug. 26, 2014. All of the applications are incorporated by reference herein in their entirety.

FIELD OF INVENTION

The invention relates to a turbine blade for a turbomachine.

BACKGROUND OF INVENTION

Turbomachines, especially gas turbines (in the broader sense), have a gas turbine (in the narrower sense) in which a hot gas, which beforehand has been compressed in a compressor and heated in a combustion chamber, is expanded to produce work. For high mass flows of the hot gas, and therefore high power ranges, gas turbines are constructed in an axial structural design, wherein the gas turbine is formed from a plurality of blade rings which are in series in the throughflow direction. The blade rings have impeller blades and diffuser blades which are arranged over their circumference, wherein the impeller blades are fastened on a rotor of the gas turbine and the diffuser blades are fastened on the casing of the gas turbine.

Such turbine blades are known from JP 206 307 842 A.

The higher the inlet temperature of the hot gas in the gas turbine is, the higher is the thermodynamic efficiency of gas turbines. However, limits are set upon the level of the inlet temperature by the thermal loadability of the turbine blades. Consequently, an aim is to create turbine blades which even in the case of high thermal loads have an adequate mechanical strength for operation of the gas turbine. To this end, turbine blades are provided with costly coating systems. For further increase of the permissible turbine inlet temperature turbine blades are cooled during operation of the gas turbine. In this case, film cooling constitutes a very effective and reliable method for cooling highly stressed turbine blades. In this, cool air is tapped from the compressor and guided into the turbine blades which are provided with internal cooling passages. After convective cooling of the materials from the inner side of the turbine blades, the air is directed onto the outer surface of the turbine blades by means of fluid passages. There, it forms a film which flows along the outer surface of the turbine blade and cools these and also protects them from the hot flow at the same time.

An ideal film cooling could be achieved with the aid of a slot blow-out system. Since this cannot be realized on turbine blades from the structural-mechanical point of view, cylindrical fluid passages or even fluid passages with an oval cross section are used in the first instance on account of manufacturability. Close to the principle of slot cooling, it is furthermore known to widen the cross section of the flow passages at their outlet, i.e. in the manner of a diffuser in their outflow passage section. In this case, the outlet cross section is increased by a determined factor. This leads to a fanning-out of the cooling air jet which, independently of the flow situation, involves a lowering of the jet impulse, lower mixing losses and a larger lateral covering. It is generally considered that contoured holes lead to an increase of effectiveness in the region of the fluid-passage longitudinal axis and overall to a better lateral covering.

Trials have shown that the cooling air in the fluid passages or cooling passages separates from their wall. As shown in FIG. 14, such a separation takes place especially in the outflow passage section of diffuser-like design of the fluid passage, specifically on its downstream wall region, as seen with regard to the flow direction of the hot gas, or wall region situated toward the cold gas side. Furthermore, trials have shown that when the fluid passages are exposed to throughflows vortex formations occur, as are shown in FIG. 15. Four different vortex structures can be identified in the main.

Annular vortices Ω1: The cooling air jet acts like an inclined cylinder upon the main flow and accelerates this. Pressure differences are formed between the side facing upstream and downstream and the upper side of the cooling air jet, which lead to a compensating flow. As a result, annular vortices Ω1 are formed. The rotation of the discharging boundary layer of the cooling air supports this effect.

Reniform vortices Ω2: The reniform vortices are a result of a vortex pair which occurs in the fluid passage. Friction forces in the free shear layer between the discharging cooling fluid jet and the main flow additionally intensify the rotation.

Horseshoe vortices Ω3: Horseshoe vortices Ω3 occur in the stagnant zone of a cylinder which is vertical in a boundary layer flow. Close to the wall, the pressure in the boundary layer is minimal. In contrast to this, in the outer layer of the main-flow boundary layer a positive pressure gradient is formed. The boundary layer separates and rolls against the wall against the main flow in the direction of the pressure minimum. The ensuing vortex is located on both sides around the cylinder. The direction of rotation of the horseshoe vortices Ω3 is opposite to that of the adjacent reniform vortices Ω2, and the horseshoe vortices Ω3 extend laterally beneath the cooling air jet during individual-hole blow-out.

Unsteady vortices Ω4: The unsteady vortices are comparable to Kármán vortices in the wake of a cylinder. The cause of the vortex formation is the boundary layer separation on the suction side of the cylinder. The unsteady vortices Ω4 occur vertically on the cooled surface.

If, therefore, hot gas from a combustion chamber of the turbomachine on the outer surface of the turbine blade meets a jet of cooling fluid discharging from the fluid passage, then the flow of hot gas is distributed around the cooling fluid jet, and a chimney vortex, with two vortex arms Ω2, is formed as a result of the action of the hot gas on the jet edge. Each of the two vortex arms Ω2 is formed by one vortex, wherein the velocity vectors of the hot gas on the two inner sides of the vortex arms point away from the outer wall.

In order to influence the vortex formation, it is known to provide turbolators in the form of fins or pins in the fluid passages (see WO 2013/089255 A1 and US 2009/0304499 A1).

SUMMARY OF INVENTION

The aims are to further increase the film cooling capacity. Accordingly, it is an object of the present invention to create a turbine blade for a turbomachine which can be effectively cooled using film cooling.

This object is achieved according to the invention in a turbine blade of the type referred to in the introduction by means of the characterizing features as claimed.

According to the invention, it is therefore provided that the central passage section adjoins the intermediate passage section, forming a shoulder face which lies between them and lies perpendicularly to the longitudinal axis of the fluid passage. Alternatively, a shoulder face, which lies in a plane which is inclined to the longitudinal axis of the fluid passage at an angle of $\alpha \neq 90°$, for example about 45°, can be formed in the transition region between the intermediate passage section and the central passage section. In this case, the shoulder face is formed on a wall region of the fluid passage, whereas on the opposite wall region the intermediate passage section and the central passage section merge into each other in a straight line, i.e. without a shoulder being formed. The wall of the fluid passage can especially extend in a straight line over its entire length in this case. Alternatively, a shoulder with a low shoulder height can also be formed here, however.

The shoulder face advantageously lies on the wall region of the fluid passage which faces the hot gas side or the cold gas side.

According to one embodiment of the invention, provision is made between the central passage section and the inflow passage section for an intermediate passage section which has a constant, advantageously circular or oval, cross section over its length, wherein the longitudinal axis of the intermediate passage section is offset in relation to the longitudinal axis of the central fluid passage section and especially extends parallel to this.

It has been shown that as a result of the change of geometry which is undertaken according to the invention the flow of cooling fluid in the fluid passage can be influenced in a way that the local flow velocities in the fluid passage are adjusted in such a way that on the one hand vortex pairs Ω2, which are shown in FIG. 15, rotate the other way round and on the other hand the separation in the diffuser can be displaced towards the upstream side, as is shown in FIG. 13. Both effects have a positive influence on the film cooling effectiveness and can especially affect the lateral spread of the cooling fluid jet.

It has been shown that particularly good results are achieved if the central passage section has a cross-sectional area which is smaller by at least 30%, especially by at least 40% and advantageously by at least by 60%, in relation to the intermediate passage section.

If the central passage section and the intermediate passage section each have a circular cross section, the diameter D of the intermediate passage section and the diameter d of the central passage section are advantageously in the ratio of D/d=1.3 to 1.7, especially D/d=1.5.

The outflow passage section can be designed in a known way with a widening cross section in the manner of a diffuser. In this case, the wall of the fluid passage on its wall region which faces the cold gas side extends in the direction of the longitudinal axis of the fluid passage and adjoins the central passage section in a straight line. Alternatively, it can be provided that the outflow passage section has a constant, especially round, cross section over its entire length. In this case, the outflow passage section advantageously extends concentrically to the central passage section and has the same cross section as this.

BRIEF DESCRIPTION OF THE DRAWINGS

With regard to advantageous embodiments of the invention, reference is made to the following description of an exemplary embodiment. In the drawing

DETAILED DESCRIPTION OF INVENTION

Figure 1:
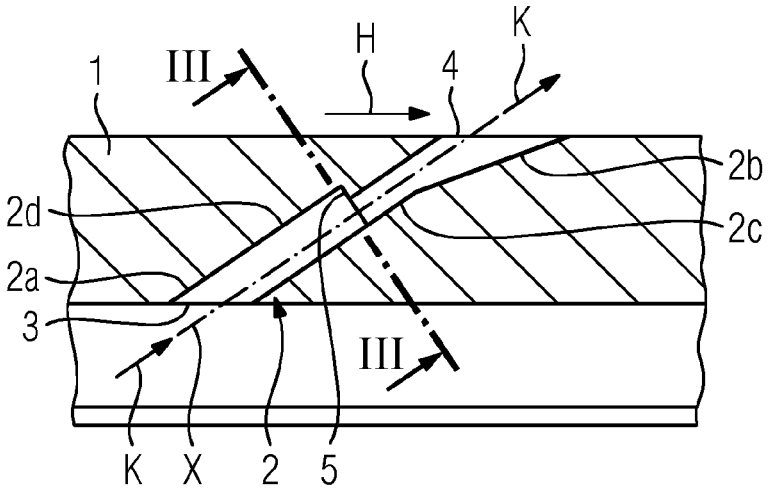
FIG. 1 shows a longitudinal section through a turbine blade wall having a fluid passage which is designed according to the invention.

Shown in FIG. 1 in a longitudinal section is a detail of a turbine blade wall 1 in which is formed a fluid passage 2 through which a cooling fluid, such as cooling air, can flow from a cold gas side of the turbine blade—in this case the interior of the turbine blade—to an outer surface of the turbine blade wall 2, over which hot gas flows, which forms a hot gas side of the turbine blade. The fluid passage 2, on its end region which points toward the cold gas side, has an inflow passage section 2*a* with a fluid inlet opening 3, on its end region which points toward the hot gas side of the turbine blade wall 1 has an outflow passage section 2*b*, which widens out in the manner of a diffuser, with a fluid outlet opening 4, and between the inflow passage section 2*a* and the outflow passage section 2*b* has a central passage section 2*c* which defines a longitudinal axis X of the fluid passage 2 and has a constant circular or oval cross section over its length. The longitudinal axis X of the fluid passage 2, with the surface of the turbine blade wall 1 over which the hot gas flows, includes an acute angle which is measured between the longitudinal axis X and the surface on the inflow side upstream side of the fluid passage. Between the inflow passage section 2*a* and the central passage section 2*c* provision is made for an intermediate passage section 2*d* which has a larger cross-sectional area than the central passage section 2*c*. It can be seen in FIG. 1 that the inflow passage section 2*a* and the intermediate passage section 2*d* are designed as a through-hole so that the intermediate passage section 2*d* adjoins the inflow passage section 2*a* in a straight line and has a constant cross section over its length.

Figure 2:
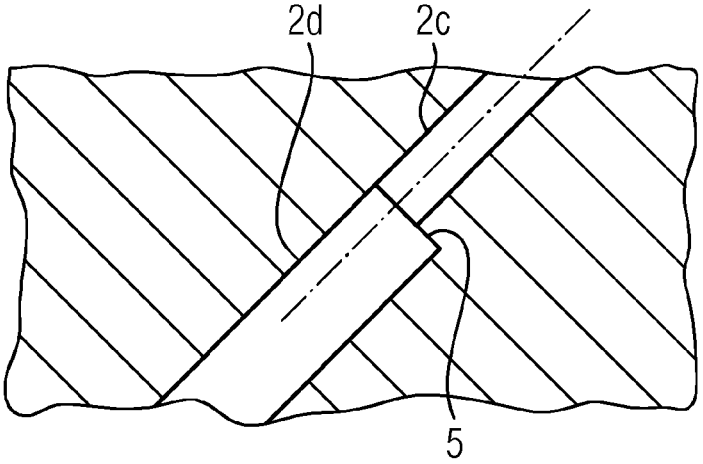
FIG. 2 shows in longitudinal section a variant of the turbine blade wall which is shown in FIG. 1.

The transition region between the intermediate passage section 2*d* and the central passage section 2*c* is of sharp-edged design, wherein the wall of the fluid passage 2 on that side of the fluid passage 2 which faces the cold gas side extends in a straight line, and on the opposite wall region which faces the hot gas side a shoulder face 5 is formed between the intermediate passage section 2*d* and the central passage section 2*c* and lies perpendicularly to the longitudinal axis X of the fluid passage 2. Alternatively, it is also possible, however, as shown in FIG. 2, to form the shoulder face 5 between the intermediate passage section 2*d* and the central passage section 2*c* on the wall region which faces the cold gas side, wherein on the opposite wall region, i.e. which faces the hot gas side, the wall of the fluid passage 2 then extends in a straight line, i.e. without a shoulder being formed.

Figure 3:
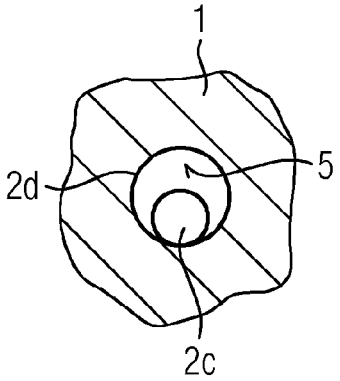
FIG. 3 shows a cross-sectional view along the line V-V in FIG. 1, in which the cross-sectional geometries of the fluid passage in the intermediate passage section and in the central passage section can be seen.
Figure 4:
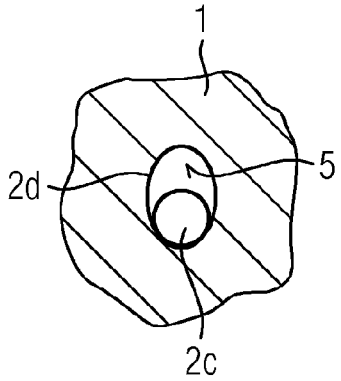
FIG. 4 shows a cross-sectional view along the line V-V in FIG. 1, in which alternative cross-sectional geometries of the fluid passage in the intermediate passage section and in the central passage section are shown.

In FIGS. 3 and 4, the transition from the intermediate passage section 2*d* to the central passage section 2*c* of the fluid passage 2 can be clearly seen. In the case of the embodiment according to FIG. 2, the intermediate passage section 2*d* and the central passage section 2*c* have in each case a circular cross section, wherein the diameter D of the intermediate passage section 2*d* is significantly larger than the diameter 2*d* of the central passage section 2*c*. In the depicted exemplary embodiment, the diameter ratio D/d is about 1.5. The result of this is that the cross-sectional area of the central passage section 2*c* has a cross-sectional area which is smaller by about 55% than the intermediate passage section 2*d*. On the downstream wall region of the fluid passage 2 the intermediate passage section 2*d* merges into the central passage section 2*c* in a straight line, whereas in the remaining circumferential regions the shoulder face 5 is formed between the two passage sections 2*d*, 2*c*.

In the embodiment according to FIG. 4, the intermediate passage section 2*d* has an oval cross section and the central passage section 2*c* has a round cross section. On account of the oval design of the intermediate passage section 2*d* the shoulder face 5 is provided only on the upstream wall region of the fluid passage 2.

Figure 13:
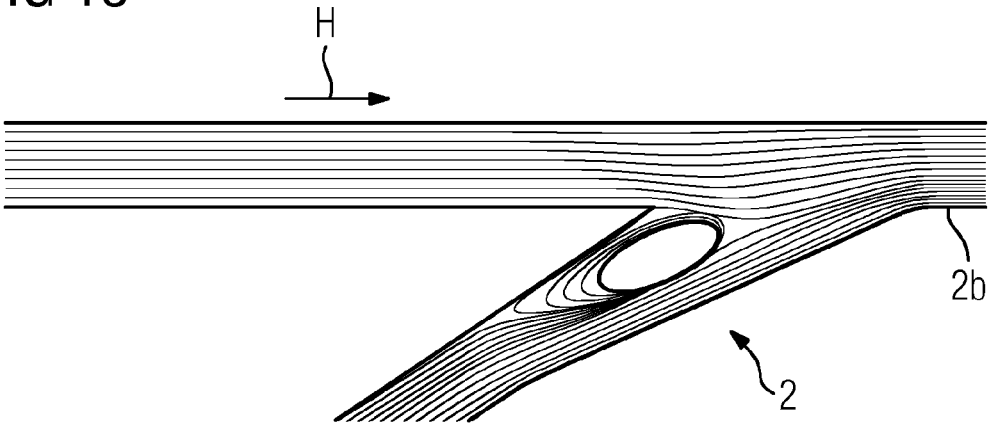
FIG. 13 shows a schematic view which shows the position of the separation of the cooling fluid in the diffuser in the embodiment of the fluid passage according to FIGS. 1, 5 and 6.
Figure 14:
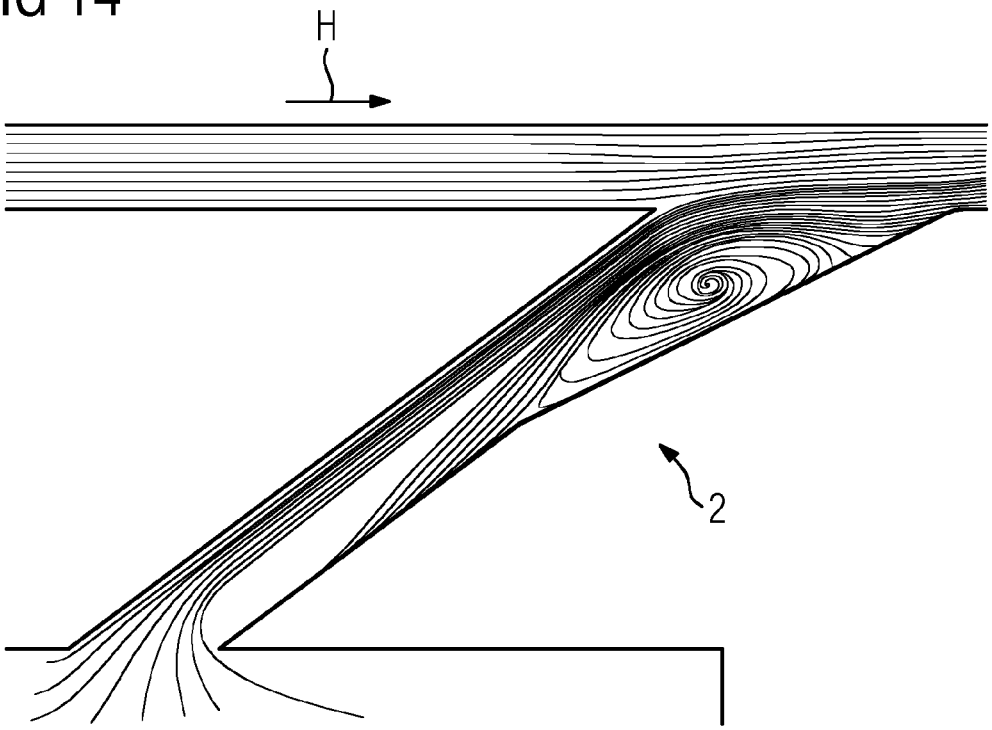
FIG. 14 shows a schematic view which shows the separation behavior of the cooling fluid in the diffuser in conventional fluid passages with a diffuser.
Figure 15:
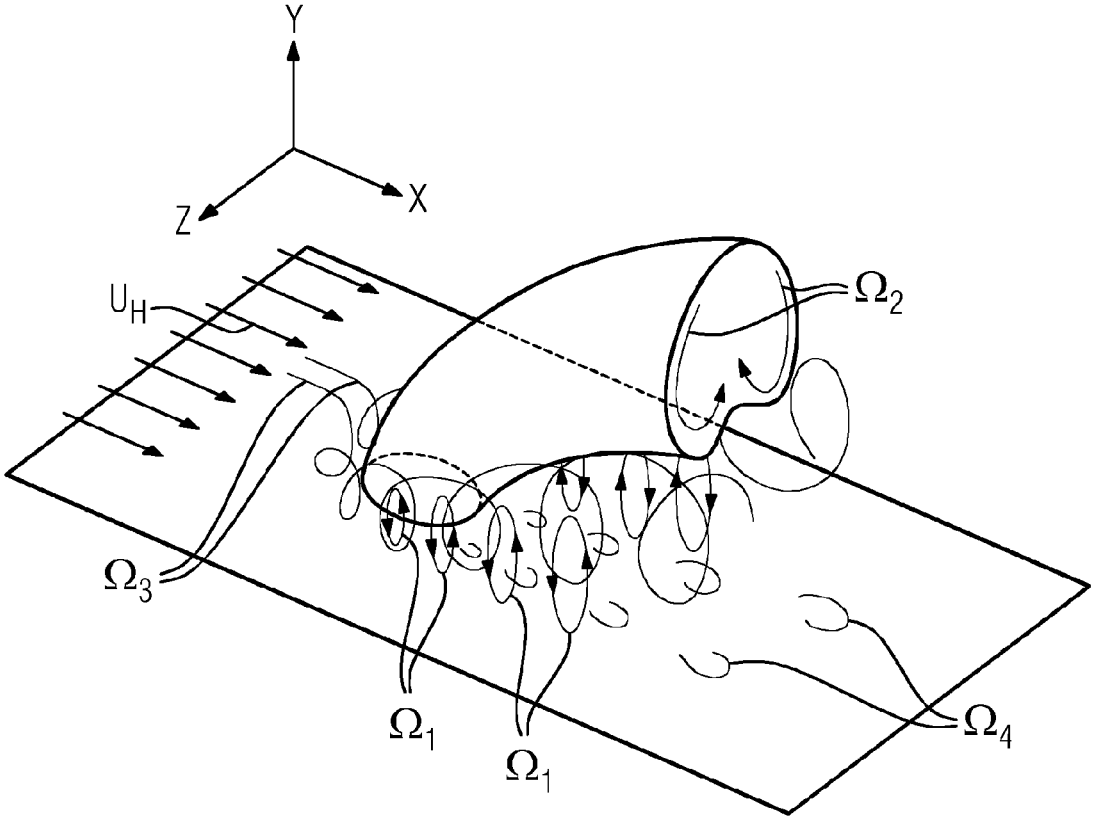
FIG. 15 shows a schematic view which shows the vortex formation of a cylindrical film cooling hole.

If during operation the fluid passage 2 is exposed to a throughflow of cooling fluid, such as cooling air, the sharp-edged constriction in the transition region between the intermediate passage section 2*d* and the central passage section 2*c* leads to the cooling fluid flow—as shown in FIG. 13—separating in the outflow passage section 2*b*, which is widened out in the manner of a diffuser, from the wall of the fluid passage on its upstream side with regard to the hot gas flow H. As FIG. 13 indicates, as a result of this the cooling fluid after leaving the fluid passage 2 is optimally applied to the outer surface of the turbine blade wall 1 in order to protect this against the hot gas flowing over it.

Figure 5:
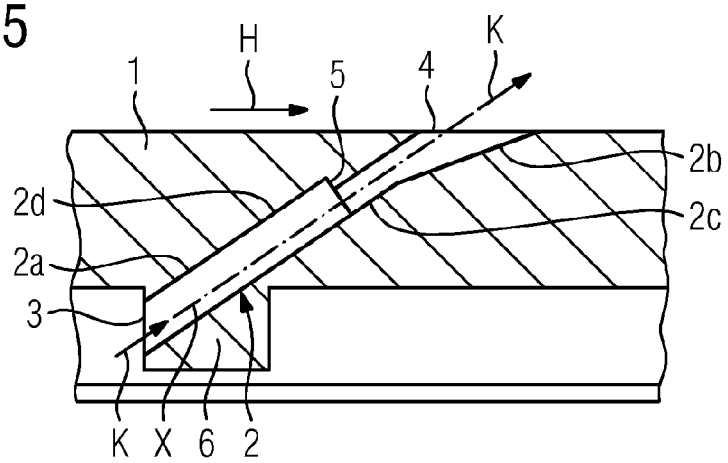
FIG. 5 shows a sectional view through a turbine blade wall with a further fluid passage designed according to the invention, according to the present invention.

Shown in FIG. 5 is a similar fluid passage 2 in a turbine blade wall 1. The only difference to the embodiment shown in FIG. 1 is that the fluid inlet opening 3 is formed in the end face of a fillet 6 which projects inward from the inner face of the turbine blade wall 1 so that the cooling fluid enters the fluid passage 2 on the end face.

Figure 6:
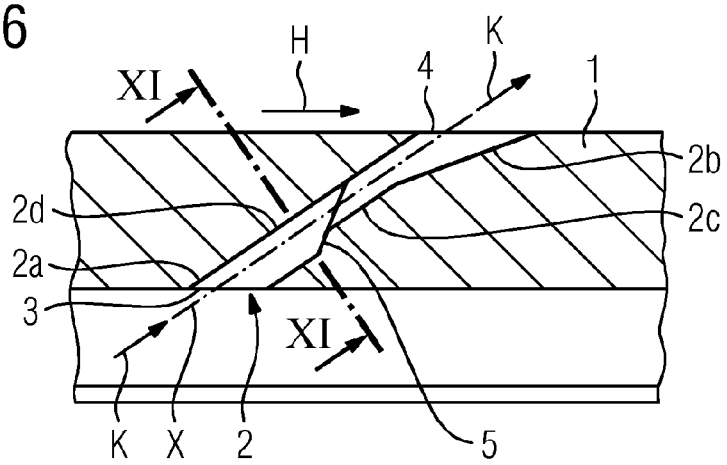
FIG. 6 shows a sectional view through a turbine blade wall with a third embodiment of a fluid passage according to the present invention.
Figure 11:
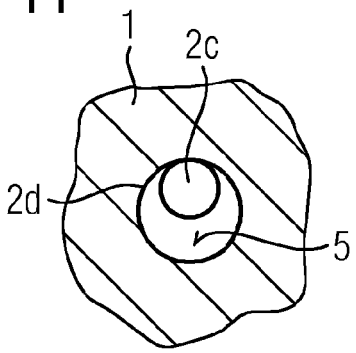
FIG. 11 shows a cross-sectional view along the lines A-A in FIGS. 6 and 10, in which the cross-sectional geometries of the fluid passage in the intermediate passage section and in the central passage section are shown.
Figure 12:
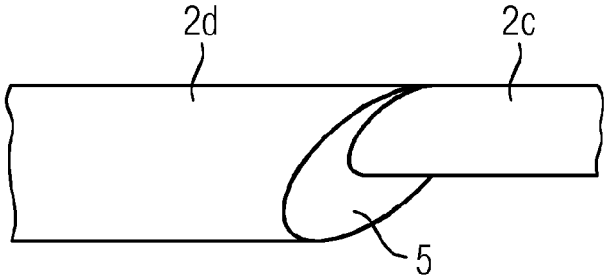
FIG. 12 shows a three-dimensional view of the fluid passage which is shown in FIG. 10 in the transition region between the intermediate passage section and the central passage section.

Shown in FIG. 6 is a further embodiment of a fluid passage 2 in a turbine blade wall 1. This, in the same way as the fluid passage 2 according to FIG. 1, comprises an inflow passage section 2*a* on the cold side of the turbine blade wall 1, an outflow passage section 2*b* on the hot side of the turbine blade wall 1, a central passage section 2*c* which lies between the inflow passage section 2*a* and the outflow passage section 2*b* and has a circular cross section which is constant over its length, and also an intermediate passage section 2*d* which is formed between the inflow passage section 2*a* and the central passage section 2*c*. The inflow passage section 2*a* and the intermediate passage section 2*d* are designed in this case in the style of a cylindrical hole with a diameter which is constant over the length and larger than the diameter of the central passage section 2*c*. Furthermore, the longitudinal axis, which is defined by the intermediate passage section 2*d* and the inflow fluid passage 2*a*, is offset in relation to the longitudinal axis X of the central passage section 2*c*. Specifically, the arrangement is affected so that between the intermediate passage section 2*d* and the central passage section 2*c* a shoulder face 5 is formed on the side of the fluid passage 2 which points toward the cold gas side, whereas on the opposite side, i.e. the side which points toward the hot gas side, the fluid passage wall in the transition region between the intermediate passage section 2*d* and the central passage section 2*c* extends in a straight line, therefore in this case a constant transition from the intermediate passage section 2*d* into the central passage section 2*c* takes place without a shoulder being formed. In contrast to the embodiment of FIG. 1, the shoulder face 5 does not lie perpendicularly to the longitudinal axis of the fluid passage but lies in a plane which is inclined by about 45° in relation to the longitudinal axis X. The transition region can be seen in the cross section of FIG. 11.

Figure 7:
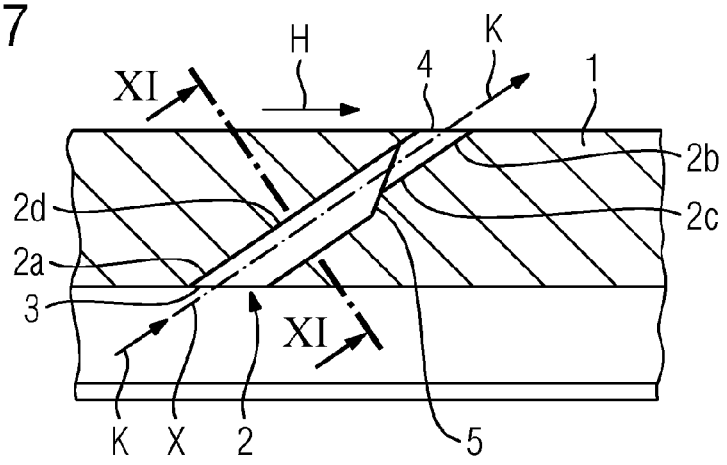
FIGS. 7 to 9 show in longitudinal section variants of the turbine blade wall which is shown in FIG. 6.
Figure 8:
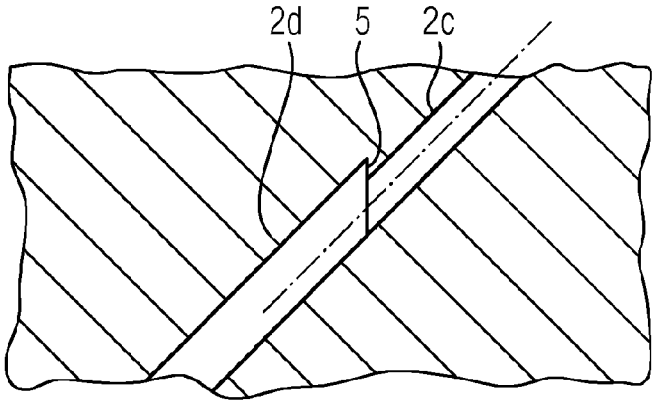
Figure 9:
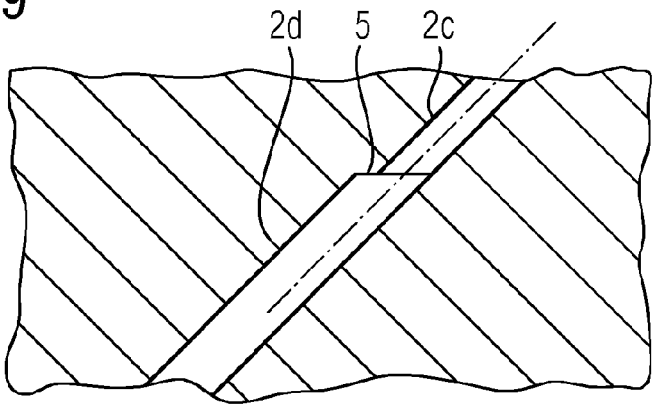

Alternatively to the embodiment shown in FIG. 5, the shoulder face can also be formed on the wall region of the fluid passage 2 which points toward the hot gas side, whereas on the opposite side, i.e. the side pointing toward the cold gas side, the fluid passage wall then extends in a straight line in the transition region between the intermediate passage section 2*d* and the central passage section 2*c*. Such embodiments are shown in FIGS. 7 and 8. FIG. 7 also reveals that the plane in which the shoulder face 5 lies includes an angle of <90° with the wall region which is situated toward the hot gas side so that a type of setback is formed. Similarly, in the embodiment shown in FIG. 6 the shoulder face 5 can also include an angle of <90° with the wall region which is situated toward the cold gas side, forming a setback, as is shown in FIG. 9.

Figure 10:
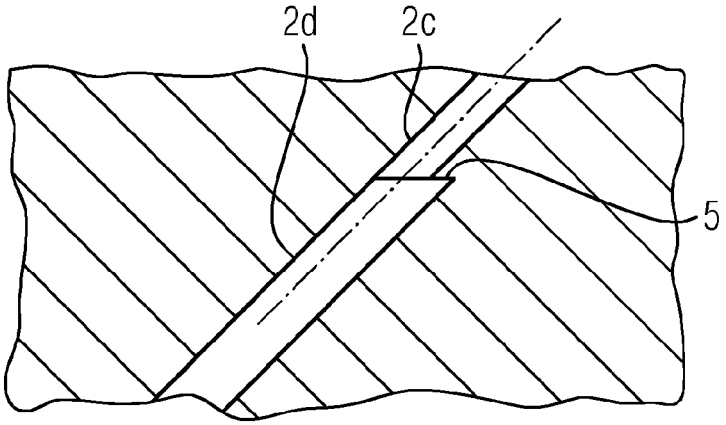
FIG. 10 shows a longitudinal section through a turbine blade wall with a fourth embodiment of a fluid passage according to the present invention.

In the embodiment shown in FIG. 6, the outflow passage section 2*b* is designed in the manner of a diffuser. Alternatively, the outflow passage section 2*b*, as shown in FIG. 10, can also constitute a continuation of the central passage section 2*c*. In this case, the inflow passage section 2*a* and the intermediate passage section 2*d* form a hole of greater diameter and the central passage section 2*c* and the outflow passage section 2*b* form a hole of smaller diameter, wherein the holes are offset in such a way that a shoulder face 5 is formed in the transition region between the intermediate passage section 2*d* and the central passage section 2*c* on the downstream side of the fluid passage wall.

As a result of the embodiment of the fluid passage 2 according to FIGS. 6 and 10, the same effect is achieved during operation as by the embodiment of the fluid passage 2 according to FIGS. 1 and 4. On account of the enlarged diameter of the fluid passage 2 in the inflow passage section 2*a* and intermediate passage section 2*d*, the cooling fluid in the fluid passage 2 is first of all decelerated and then accelerated and deflected in the region of the inclined shoulder face 5 in such a way that separation of the cooling fluid flow takes place in the region of the upstream side of the fluid passage wall.

Although the invention has been fully illustrated and described in detail by means of the preferred exemplary embodiment, the invention is not then limited by the disclosed examples and other variations can be derived by the person skilled in the art without departing from the extent of protection of the patent.

The invention claimed is:

1. A turbine blade for a turbomachine comprising:

a turbine blade wall in which is formed at least one fluid passage through which a cooling fluid can flow from a cold gas side to a hot gas side of the turbine blade wall, and wherein the at least one fluid passage on its end region which points toward the cold gas side has an inflow passage, on its end region which points toward the hot gas side of the turbine blade wall has an outflow passage section, and between the inflow passage section and the outflow passage section has a central passage section with a circular or oval cross section which is constant over the length and which defines a longitudinal axis of the fluid passage which with the surface of turbine blade wall over which hot gas flows includes an acute angle, wherein between the inflow passage section and the central passage section the fluid passage has an intermediate passage section which has a larger cross-sectional area than the central passage section, wherein the central passage section adjoins the intermediate passage section forming one of a shoulder face which lies between them and perpendicularly to the longitudinal axis of the fluid passage, and a shoulder face, which lies in a plane which is inclined to the longitudinal axis of the fluid passage by an angle of $\alpha \neq 90°$, is formed in the transition region between the intermediate passage section and the central passage section, wherein the shoulder face is formed on a wall region of the fluid passage, and on the opposite wall region, the intermediate passage section and the central passage section merge into each other in a straight line, without a shoulder being formed.

2. The turbine blade as claimed in claim 1, wherein the intermediate passage section has a constant cross section over its length.

3. The turbine blade as claimed in claim 2, wherein the intermediate passage section has a circular or oval cross section, and the longitudinal axis of the intermediate passage section is offset in relation to the longitudinal axis of the central fluid passage section.

4. The turbine blade as claimed in claim 1, wherein the shoulder face is formed on the wall region of the fluid passage which faces the hot gas side.

5. The turbine blade as claimed in claim 1, wherein the shoulder face is formed on the wall region of the fluid passage which faces the cold gas side.

6. The turbine blade as claimed in claim 1, wherein the central passage section has a cross-sectional area which is smaller by least 30% in relation to the intermediate passage section.

7. The turbine blade as claimed in claim 6, wherein the central passage section and the intermediate passage section each have a circular cross section and the diameter (D) of the intermediate passage section and the diameter (d) of the central passage section are in a ratio of D/d=1.3 to 1.7.

8. The turbine blade as claimed in claim 7, wherein the ratio of D/d=1.5.

9. The turbine blade as claimed in claim 6, wherein the central passage section has a cross-sectional area which is smaller by least 40% in relation to the intermediate passage section.

10. The turbine blade as claimed in claim 6, wherein the central passage section has a cross-sectional area which is smaller by least 60% in relation to the intermediate passage section.

11. The turbine blade as claimed in claim 1, wherein the outflow passage section is designed with a widening cross section in the manner of a diffuser.

12. The turbine blade as claimed in claim 11, wherein the wall of the fluid passage, on its wall region which faces the cold gas side, extends in the direction of the longitudinal axis of the fluid passage and adjoins the central passage section in a straight line.

13. The turbine blade as claimed in claim 1, wherein the outflow passage section has a constant cross section over its entire length.

14. The turbine blade as claimed in claim 13, wherein the outflow passage section extends concentrically to the longitudinal axis of the fluid passage.

15. The turbine blade as claimed in claim 14, wherein the outflow passage section has the same cross section as the central passage section.

16. The turbine blade as claimed in claim 13, wherein the outflow passage section has a constant, circular, cross section over its entire length.

17. The turbine blade as claimed in claim 1, wherein the turbine blade is manufactured in the precision casting process.

* * * * *